United States Patent [19]

Weber et al.

[11] Patent Number: 4,473,921

[45] Date of Patent: Oct. 2, 1984

[54] CLEANING DEVICE FOR THE INTERNAL PERIPHERAL SURFACES OF PIPELINES OR HOLLOW CYLINDRICAL VESSELS, ESPECIALLY FOR MANIPULATORS FOR THE INTERIOR OF PIPES

[75] Inventors: Robert Weber, Uttenreuth; Siegfried Förner, Erlangen, both of Fed. Rep. of Germany

[73] Assignee: Kraftwerk Union Aktiengesellschaft, Mülheim, Fed. Rep. of Germany

[21] Appl. No.: 419,596

[22] Filed: Sep. 17, 1982

[30] Foreign Application Priority Data

Oct. 6, 1981 [DE] Fed. Rep. of Germany ..... 3139691

[51] Int. Cl.[3] ..... B08B 9/08

[52] U.S. Cl. ..... 15/304; 15/395; 15/409; 15/104.09; 15/88

[58] Field of Search ..... 15/304, 395, 409, 88, 15/104.06 R, 104.09, 104.12, 104.13, 104.05

[56] References Cited

U.S. PATENT DOCUMENTS

| | | | |
|---|---|---|---|
| 1,869,730 | 8/1932 | Anthe | 15/395 |
| 2,273,347 | 2/1942 | Crane | 15/104.06 R |
| 2,275,190 | 3/1942 | Lowry | 15/104.06 R |
| 2,332,984 | 10/1942 | Brackeen | 15/104.06 R |
| 2,509,604 | 6/1950 | McGregor | 15/395 |
| 2,909,796 | 10/1959 | Ver Nooy | 15/104.06 R |
| 2,957,189 | 10/1960 | Nelson et al. | 15/104.06 R |
| 2,959,798 | 11/1960 | Cribley | 15/104.06 R |
| 2,974,337 | 3/1961 | White | 15/104.06 R |
| 3,107,386 | 10/1963 | Mandin | 15/409 |
| 3,446,666 | 5/1969 | Bodine | 15/104.05 |
| 3,708,819 | 1/1973 | Breston | 15/104.06 R |
| 3,800,358 | 4/1974 | Ryan | 15/395 |
| 3,946,459 | 3/1976 | Armstrong | 15/395 |
| 4,027,349 | 6/1977 | Clavin | 15/104.12 |
| 4,044,420 | 8/1977 | Hanson | 15/304 |

FOREIGN PATENT DOCUMENTS

| | | |
|---|---|---|
| 2335868 | 1/1975 | Fed. Rep. of Germany . |
| 2444863 | 3/1975 | Fed. Rep. of Germany . |
| 750592 | 6/1956 | United Kingdom . |
| 2070493 | 9/1981 | United Kingdom . |

*Primary Examiner*—Harvey C. Hornsby
*Assistant Examiner*—M. Knick
*Attorney, Agent, or Firm*—Herbert L. Lerner; Laurence A. Greenberg

[57] ABSTRACT

Cleaning device for the internal peripheral surfaces of pipelines or hollow cylindrical vessels, including instrument carriers having at least one working head being fixable in a working position and being movable along defined feed paths through the interior of the pipelines or vessels which are invisible from the outside, and instruments mounted on the at least one working head, the instruments including rotatable brushes being mounted on said working head and being pressable against inner wall surfaces to be cleaned, at least one suction nozzle being mounted on the working head and being movable into alignment with a given brush engagement region of a pipeline or vessel, an injector having a suction side connected to the suction nozzle, a discharge side and a propulsion nozzle, a propellant line feeding the propulsion nozzle of the injector from outside the pipeline or vessel, and a dust collecting bag connected downstream of the discharge side of the injector.

10 Claims, 6 Drawing Figures

Figures 1, 3, 4, 5, 6:
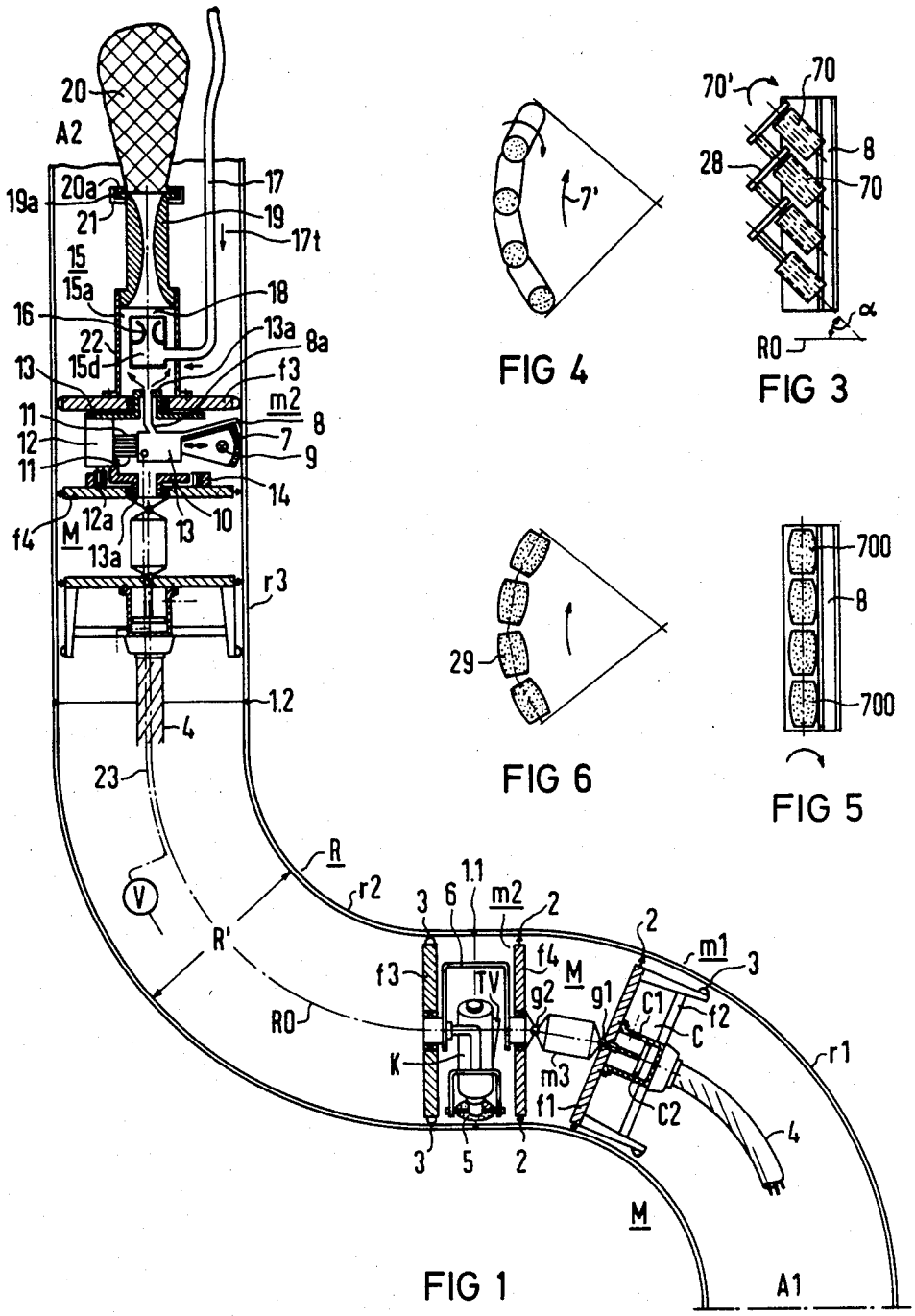

CLEANING DEVICE FOR THE INTERNAL PERIPHERAL SURFACES OF PIPELINES OR HOLLOW CYLINDRICAL VESSELS, ESPECIALLY FOR MANIPULATORS FOR THE INTERIOR OF PIPES

The invention relates to a cleaning device for the internal peripheral surfaces of pipelines or hollow cylindrical vessels having instrument carriers equipped with testing, measuring and/or machining instruments, especially on manipulators for the interiors of pipes for controlling wall and weld seams and for machining from the inside, which are transportable through the interiors of the pipelines or vessels that are invisible from the outside and are fixable in a respective working position, the instruments to be mounted on at least one working head being movable in circumferential and/or axial direction along defined feed paths.

An instrument carrier of this generic structural type has been explained more specifically in U.S. application Ser. No. 316,900, filed Oct. 30, 1981. Such instrument carriers are of great importance for the internal control and machining of pipelines. Thus, they can be used for grinding, welding, ultrasonic testing, eddy current testing, isotope testing, internal plating, inspecting by means of television systems, to name some important applications. A special problem in this connection is the evacuation of the grinding dust and the globules formed during welding. Cleaning operations are also advantageous when it is desired to photograph portions of the pipe interior or to inspect them with television cameras or with optic fiber endoscopes. On one hand, some of the dirt or metal particles adhere relatively firmly to the internal surface, and on the other hand, considerable pressure differences must be overcome during the evacuation in the case of pipe lengths in the order of 20 to 40 m, which are moreover installed with a gradient.

It is accordingly an object of the invention to provide a cleaning device for the internal peripheral surfaces of pipelines or hollow cylindrical vessels, especially for manipulators for the interiors of pipes, which overcomes the hereinfore-mentioned disadvantages of the heretofore-known devices of this general type, and with which a very effective cleaning can be obtained at a high suction capacity.

With the foregoing and other objects in view there is provided, in accordance with the invention, a cleaning device for the internal peripheral surfaces of pipelines or hollow cylindrical vessels, including instrument carriers having at least one working head being fixable in a working position and being movable along defined feed paths through the interior of the pipelines or vessels which are invisible from the outside, and instruments for testing, measuring and/or machining being mounted on the at least one working head, especially manipulators for the interiors of pipes for controlling wall and weld seams and for machining from the inside, the instruments including rotatable brushes being mounted on the working head and being pressable against inner wall surfaces to be cleaned, at least one suction nozzle being mounted on the working head and being movable into alignment with a given brush engagement region of a pipeline or vessel in axial and/or circumferential direction, an injector having a suction side connected to the suction nozzle, a discharge side and a propulsion nozzle, a propellant line feeding the propulsion nozzle of the injector from outside the pipeline or vessel, and a dust collecting bag connected downstream of the discharge side of the injector.

In accordance with another feature of the invention, there is provided a brush holder for the brushes being in the shape of a substantially circular sector adapted to the curvating of the inner surface of the pipeline or vessel and oriented obligingly to a plane being normal to the axis of the pipeline or vessel, the brush holder being movable with the brushes protruding over the arcuate outer periphery of the brush holder and being elastically adjustable relative to the periphery of the inner surface, in circumferential direction of the pipeline or vessel.

In accordance with a further feature of the invention, there is provided a rim or partial rim carrying the brushes individually, each of the brushes being rotatable about the respective axes thereof and being elastically pressable against the inner surface of the pipeline or vessel, and being feedable by a movement superposed on the rim or partial rim in circumferential direction of the inner surface.

In accordance with an additional feature of the invention, the individual brushes are disposed with the axes of rotation thereof at a given angel of inclination relative to the axis of the pipeline or vessel wall.

In accordance with an added feature of the invention, the individual rotatable brushes are disposed with the axes of rotation thereof normal to the axis of the pipeline or vessel and the brushes have a barrel-shaped contour being adapted to the inner periphery of the pipeline or vessel.

In accordance with yet another feature of the invention, the brushes are disposed along an arc and the suction nozzle is arcuate and has a slit formed therein following the rim or brush arc, as seen in particle travel direction.

In accordance with again another feature of the invention, there is provided a blowing line branched off from said propellant line, and a blow nozzle opening into said brush engagement region from the blowing line.

In accordance with a further feature of the invention, there is provided a compressed air blow line being separate from the propellant line, and a blow nozzle opening into the brush engagement region from the blowing line.

In accordance with an additional feature of the invention, the brushes are pneumatically adjustable relative to an inner peripheral region of the pipeline or vessel to be cleaned.

In accordance with again an additional feature of the invention, the cleaning instruments are disposed on the working head of the instrument carrier as a supplementing unit.

In accordance with yet another feature of the invention, the cleaning instruments are disposed on another working head of their own being alternatively or additionally coupleable to the first-mentioned working head, especially by a universal joint.

In accordance with a further feature of the invention, the injector is a compressed air-propelled injector.

The advantages achievable with the invention must be seen above all in the fact that instrument carriers, which in particular are pipe interior manipulators that are movable in the interior of hollow cylindrical elongated bodies, can now be equipped in a simple manner with a cleaning head which can carry out the required cleaning before and after the testing, measuring, or machining operations. In principle it is even possible to combine, e.g., a grinding head of the instrument carrier with a cleaning device according to the invention to form a grinding-cleaning head, the advantage being that the grinding dust is removed as soon as it forms. The brushes may be wire brushes, especially steel wire brushes. The injector is preferably pressurized with compressed air as a propellant since compressed air is available in every power plant or nuclear power plant, the preferred area of application of the instrument carrier. The special advantage of compressed air as propellant is that any suction head that may occur in practical applications is overcome effortlessly.

Other features which are considered as characteristic for the invention are set forth in the appended claims.

Although the invention is illustrated and described herein as embodied in a cleaning device for the internal peripheral surfaces of pipelines or hollow cylindrical vessels, especially for manipulators for the interior of pipes, it is nevertheless not intended to be limited to the details shown, since various modifications and structural changes may be made therein without departing from the spirit of the invention and within the scope and range of equivalents of the claims.

Figure 2:
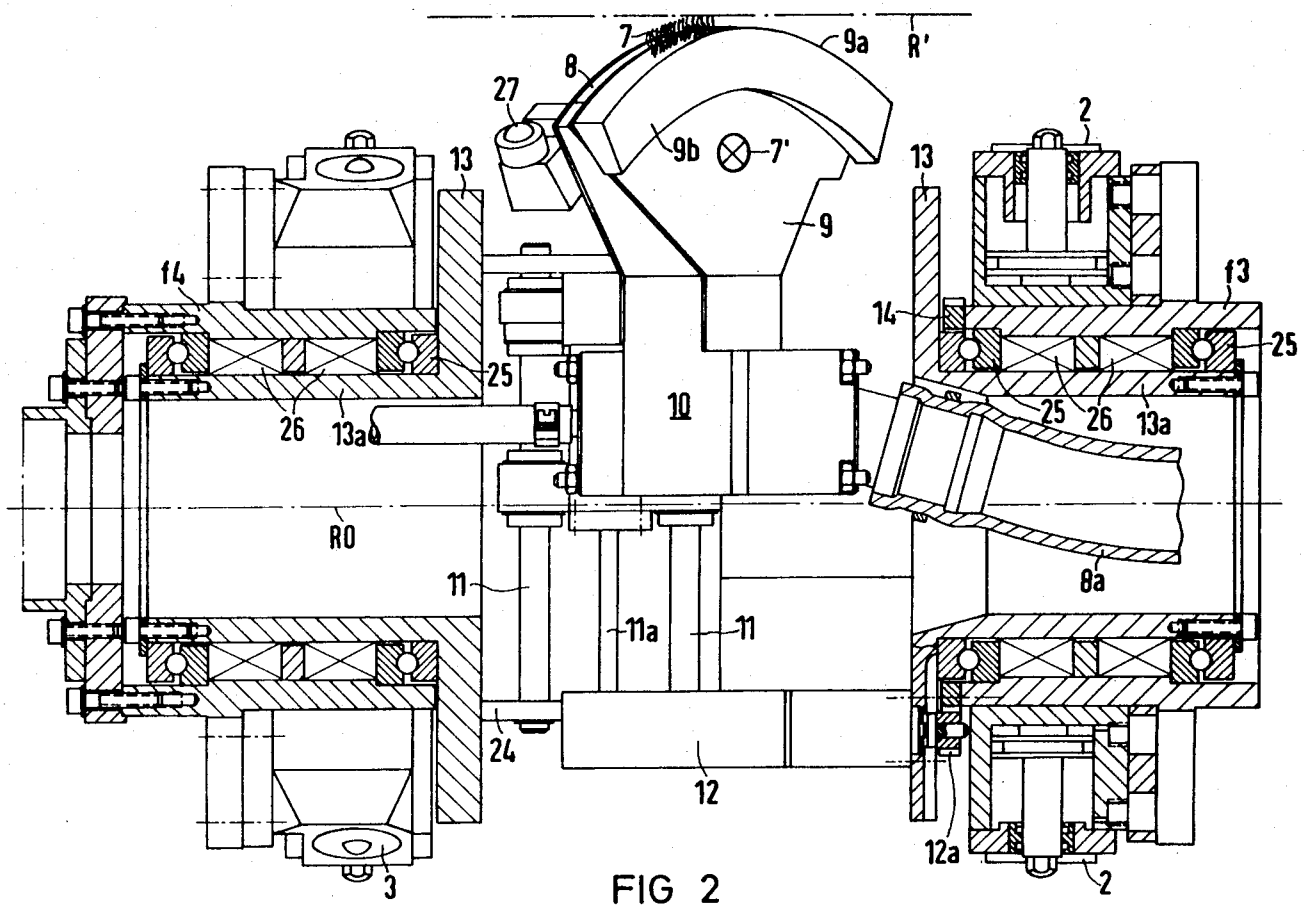

The construction and method of operation of the invention, however, together with additional objects and advantages thereof will be best understood from the following description of specific embodiments when read in connection with the accompanying drawings, in which:

FIG. 1 is a fragmentary, diagrammatic, partially cross-sectional view showing, in its lower half, an instrument carrier constructed as a manipulator for interiors of pipes with a working head in the form of a grinding head, in working position inside a pipeline, and in its upper half, an instrument carrier which is of the same kind in principle, but with a working head which carries a cleaning device, and is also in working position;

FIG. 2 is a fragmentary, enlarged scale, detailed partially perspective and partially cross-sectioned view of the reverse side of the revolving support for the brush and suction nozzle, as compared to FIG. 1;

FIGS. 3 and 4 are respective top plan and side-elevational views of a modified version of a brush sector with rotating individual brushes having axes of rotation that extend obliquely to the direction of the pipe axis; and FIGS. 5 and 6 are respective top plan and side elevational views of a third embodiment of a brush sector in which the axes of the rotating single brushes lie in a plane that is normal to the pipe axis.

Referring now to the figures of the drawing and first particularly to FIG. 1 thereof, it is seen that an S-shaped pipeline portion R of a power plant, especially a nuclear power plant, with pipe lengths r1, r2, r3 connected through circular welding seams 1.1 and 1.2, contains an instrument carrier M, which serves for carrying out testing, measuring and/or machining operations from the interior or the pipeline R, and to this end is provided with appropriate instruments. The device may therefore also be described as an interior manipulator for pipes, which serves for wall and weld seam control and machining from inside. In principle such an instrument carrier can also be used for elongated cylindrical vessels. The essential point is that the instrument carrier is transportable through the interior of the pipe, which is invisible from outside and may be fixed in the respective working position. To this end, the instrument carrier includes a working unit m2 and a feed unit m1. The two units are coupled together through an intermediate member m3 by means of two universal joints g1, g2, so that the instrument carrier can also pass through pipe bends, as illustrated.

The feed unit m1 includes a supporting flange f1 which is normal to the axis with pneumatically extendable clamping elements 2 and guide rollers 3 on its external periphery, as well as a stepping cylinder C1 with a stepping piston C2 being axially displaceable therein. The stepping cylinder is firmly connected with the supporting flange f1, and the stepping piston C2 is articulatingly connected by its piston rod to the intermediate member m3 at the joint g1. A group of supply lines 4 is brought up to the feed unit; these are electrical, pneumatic power and control lines, and water lines for cooling and flushing purposes may also be provided. A second supporting flange disposed at a distance in the axial direction from the first supporting flange f1 and supporting the rim with the guide rollers 3, has been given reference symbol f2.

Mounted between two supporting flanges f3 and f4 of the working unit m2 which are normal to the axis, is a working head K which in the embodiment shown includes a grinding unit 5 with a television camera TV. The grinding unit is mounted in such a way as to revolve with the television camera on a U-shaped yoke 6 in corresponding pivot bearings in the center of the supporting flanges f3, f4. Motors for the rotational feed of the grinding unit and for swinging its grinding wheel inward against the pipe seam are not shown in the interest of simplicity. Pneumatically extendable clamping feet and guide rollers on the outer periphery of the supporting flanges f3, f4 are again marked with reference numerals 2 and 3, respectively.

When compressed air is applied to the right side of the stepping piston C2 with the feed unit m1 fixed (clamping feet 2 moved out) and the working unit m2 released (clamping feet 2 moved in), the working unit m2 together with the stepping piston moves to the left. After the working unit m2 is fixed and the clamping connection at the feed unit m1 is brought out of engagement, then upon pressurization of the left side of the piston, the feed unit m1 moves to the left. In this way the instrument carrier in the interior of the pipe can advance by any desired number of piston strokes or even partial piston strokes to the left, i.e. upward in the pipe, and can also be moved in the other direction for extraction of the instrument carrier. The instrument carrier automatically centers itself to the pipe center RO. The instrument carrier M shown in the upper portion of FIG. 1 is modified as compared with the instrument carrier shown in the lower portion in that its working head on the end face thereof is in the form of a cleaning device for the internal peripheral surfaces of the pipeline R. To this end, rotating brushes 7, particularly steel wire brushes, which can be pressed against the inner wall surfaces to be cleaned, are mounted at the working head m2. A suction nozzle 8 is adjustable with the brushes 7, i.e. it is rotatable in circumferential direction and movable against the inner wall of the pipe. The suction nozzle 8 is mounted in such a way as to be oriented to the brush engagement region and, as the radial plan view shows, it is in the form of a slit. It is further evident from FIG. 1 that the suction nozzle 8 and the brushes 7 are disposed on a sector-type brush holder 9, which in turn is secured on a box-type support 10, the support 10 being mounted for radially outward and inward displacement on guide rods 11. The support 10 and an axially oriented turning motor 12 are secured between two turning plates 13, each of the plates having a hub 13*a* for rotational mounting of the cleaning head at the two supporting flanges f3, f4. The motor 12 meshes with a pinion 12*a* on the inner periphery of a toothed rim 14 which is secured on the inner side of the supporting flange f4. The turning motor 12, expediently provided with a stepdown gear, can thus turn the cleaning head slowly in circumferential direction. For the purpose of pneumatically applying the brushes against the inside wall of the pipe, disposed inside the support 10 is a pneumatic adjusting cylinder, having a piston which is connected with the brush sector 9. Arrows indicate the adjusting and feed movements inside the brush sector 9. Through a flexible line 8*a* which opens into a corresponding cavity in the support 10 and passes through the hub of the plate 13, the suction nozzle 8 is connected to the suction side 15*a* of an injector 15, the pressure side of which is given reference symbol 15*d*. A propulsion nozzle 16 of the injector 15, constructed as a Laval nozzle, is fed by a propellant line 17, preferably a compressed air line, connected to it from the outside. As viewed in flow direction, the nozzle 16 is followed by a mixing chamber 18 and by a diffuser 19, the diffuser opening into a dust collecting bag 20. A flange 20*a* of the dust collecting bag 20 connects and seals a diffuser flange 19*a* by means of a cap nut 21. A housing 22 of the injector 15 is secured to the outside of the supporting flange f3 by a pedestal flange.

During operation of the injector, the propellant stream produces a strong suction at the outlet of the Laval nozzle 16, as illustrated by a arrow 17*t*. The suction becomes operative through the flow connection at the inlet of the suction nozzle 8 and it brings about a very effective evacuation. The evacuated dirt and metal particles are collected in the dust collecting bag 20. The fine fabric of the bag 20 is dustproof but permeable to air. It may be disadvantageous for improved evacuation to inject additional compressed air into the working space of the brush 7 and the suction nozzle 8. This is illustrated by a compressed air line 23 indicated in broken lines, with a valve V. The supplementary line 23 may be installed within the supply line 4. In this case an especially simple introduction through the hub of the lower turning plate 13 is possible. In principle, however, it is also conceivable to provide a branch from the propellant line 17.

Before the instrument carrier M with the cleaning device is introduced from a pipe end A1, the propellant line 17, a flexible armored tube line, is paid out from another end A2, is connected, and according to the operating program, is wound or unwound from a suitable line magazine. When the instrument carrier is removed again through the end A1 after a completed operation, the propellant line 17 is uncoupled from the injector and rolled in from the other pipe end A2.

FIG. 2 shows more clearly than FIG. 1 that a brush holder 9 (with bristles indicated at reference numeral 7) having the form of an approximately circular sector and being adapted to the curvature of the inside wall, is oriented obliquely relative to the plane of the pipe which is normal to the axis and can be moved in circumferential direction, i.e. about the pipe axis R0, with its brushes 7 projecting over the arcuate outer periphery 9*a* and being elastically adjustable against the inner wall periphery R'. The evacuating nozzle 8 is in the form of an arcuate slit nozzle disposed downstream of the brush arc in particle flight direction, which would mean a direction of rotation of the brushes along an arrow 7'. Parts similar to FIG. 1 are provided with the same reference symbols in FIG. 2. A variation has been made in FIG. 2 as compared with FIG. 1 inasmuch as the pinion 12*a* of the motor 12 does not revolve at the inner periphery of a toothed rim 14 fastened to the supporting flange, but instead it revolves on the outer periphery of such a flange. A central guide rod 11*a* is shown, which belongs to a double action pneumatic piston, the cylinder of the piston being structurally integrated with the box-type support 10. It is also clearly evident that the two turning plates 13 are non-rotationally connected together through a base frame 24. One end of each of the guide rods 11, 11*a* is anchored on the base frame 24. The hubs 13*a* of the turning plates 13 are rotatably mounted by means of thrust bearings 25 and journal bearings 26 on the supporting flanges f3, f4. Guide balls 27 in vicinity of the two arc ends of the brush sector 9 ensure a rolling friction at the inner periphery of the pipe upon wear of the brushes. The guide balls 27 protrude a little farther radially than the brush holder arc 9*b*.

FIG. 3 and FIG. 4 show a modification, with a partial rim of individual brushes 70 which spin about their axis and can be elastically pressed against the inner wall, the feed movement in circumferential direction of the pipe along an arrow 7' being superposed on the rotational movement of the individual brushes 70 (arrow 70'). The individual brushes 70 form an angle of inclination $\alpha$ with respect to the direction of the wall or pipe axis R0. The shafts of the brushes are coupled together through friction wheels and belt drives 28; the drive motor for the brushes is not shown.

According to FIG. 5 and FIG. 6, rotating individual brushes 700 are oriented with their axes of rotation crosswise relative to the pipe axis, their barrel-shaped contour 29 being adapted to the inner wall periphery. The drive may be effected through a flexible shaft which is not shown in detail.

Referring back to FIG. 1, it can be seen that coupling of the cleaning device at its front end to the working head shown in the lower part of FIG. 1 would be possible through an additional intermediate member. In this case, for the purpose of pipe cleaning it would suffice to displace the instrument carrier axially, but it would not have to be newly introduced into the pipe. However, the illustrated three-member construction of the instrument carrier with the members m1, m2 and m3 has the advantage over a five-membered construction by being lighter and more mobile. As mentioned initially herein it is also possible to construct the working unit m2 as a combination unit with a grinding head and a cleaning head. Instead of the grinding head, of course, other working heads (e.g. for welding, mill-cutting, ultrasonic testing, etc.) could be coupled to the feed unit m1.

The foregoing is a description corresponding to German Application No. P 31 39 691.7, dated Oct. 6, 1981, the International priority of which is being claimed for the instant application, and which is hereby made part of this application. Any discrepancies between the foregoing specification and the aforementioned corresponding German application are to be resolved in favor of the latter.

We claim:

1. Cleaning device for the internal peripheral surfaces of round pipelines or hollow cylindrical vessels, comprising instrument carriers having at least one working head, at least one feeding head and an intermediate link articulatingly interconnecting said working and feeding heads, said working and feeding heads being fixable in a working position and being movable through the interior of the pipelines or vessels, said working head including two support flanges disposed one after the other in direction along the pipeline or vessel, an instrument disposed between said flanges being movable along defined feed paths in circumferential direction of the pipelines or vessels said instrument including brushes, a brush holder for said brushes in the shape of a substantially circular sector adapted to the inner surface of the pipeline or vessel and oriented obliquely to a plane across the axis of the pipeline or vessel, said brushes protruding over the arcuate outer periphery of said brush holder and being elastically adjustable against the periphery of the inner surface of the pipeline or vessel, said instrument further including an arcuate suction nozzle having a slit formed therein for receiving flying particles, said suction nozzle being disposed downstream of said brush holder in particle travel direction, an injector having a suction side connected to said suction nozzle, a discharge side and a propulsion nozzle, a propellant line feeding said propulsion nozzle of said injector from outside the pipeline or vessel, and a dust collecting bag connected downstream of said discharge side of said injector.

2. Cleaning device according to claim 1, including a partial rim carrying said brushes individually, each of said brushes being rotatable about the respective axes thereof and being elastically pressable against the inner surface of the pipeline or vessel, and being feedable by a movement superposed on said partial rim in circumferential direction of the inner surface.

3. Cleaning device according to claim 1, including a rim carrying said brushes individually, each of said brushes being rotatable about the respective axes thereof and being elastically pressable against the inner surface of the pipeline or vessel, and being feedable by a movement superposed on said rim in circumferential direction of the inner surface.

4. Cleaning device according to claim 3, wherein said individual brushes are disposed with the axes of rotation thereof at a given angle of inclination relative to the axis of the pipeline or vessel wall.

5. Cleaning device according to claim 4, wherein said individual rotatable brushes are disposed with the axes of rotation thereof across the axis of the pipeline or vessel and said brushes have a barrel-shaped contour being adapted to the inner periphery of the pipeline or vessel.

6. Cleaning device according to claim 3, wherein said brushes are disposed along an arc and said slit formed in said suction nozzle follows said brush arc, as seen in particle travel direction.

7. Cleaning device according to claim 1, including a compressed air blow line being separate from said propellant line and a blow nozzle opening into said brush engagement region from said blowing line.

8. Cleaning device according to claim 1, wherein said injector is a compressed air-propelled injector.

9. Cleaning device according to claim 1, including a toothed rim disposed on one of said support flanges, two turning plates each being rotatably mounted on a respective one of said support flanges, a support mounted between said turning plates, pneumatic means for moving said support in radial direction of the pipeline or vessel, and a turning motor mounted on said support, said turning motor having a pinion engaging said toothed rim for turning said support relative to said one flange, said brush holder and said suction nozzle being disposed on said support.

10. Cleaning device according to claim 9, wherein said turning plates have hubs, said support includes a hollow chamber connected to said suction nozzle, and said instrument includes a flexible line connected from said hollow chamber through one of said hubs to said suction side of said injector.

* * * * *